US008042981B2

(12) United States Patent
Kotajima et al.

(10) Patent No.: US 8,042,981 B2
(45) Date of Patent: Oct. 25, 2011

(54) VEHICLE HEADLAMP

(75) Inventors: Takuya Kotajima, Shizuoka (JP); Satoshi Yamamura, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 123 days.

(21) Appl. No.: 12/468,587

(22) Filed: May 19, 2009

(65) Prior Publication Data

US 2009/0290372 A1 Nov. 26, 2009

(30) Foreign Application Priority Data

May 26, 2008 (JP) ..... 2008-136772

(51) Int. Cl.
*B60Q 1/00* (2006.01)

(52) U.S. Cl. ..... 362/538; 362/544; 362/520; 362/522; 362/509; 362/507

(58) Field of Classification Search ..... 362/522, 362/539, 538, 520, 544, 517–518, 516, 509, 362/521, 507
See application file for complete search history.

(56) References Cited

U.S. PATENT DOCUMENTS

| | | | | |
|---|---|---|---|---|
| 5,101,326 | A | 3/1992 | Roney | |
| 6,176,605 | B1 * | 1/2001 | Altunay et al. | 362/543 |
| 6,406,172 | B1 * | 6/2002 | Harbers et al. | 362/544 |
| 6,454,448 | B2 * | 9/2002 | Taniuchi et al. | 362/517 |
| 6,857,768 | B2 * | 2/2005 | Watanabe et al. | 362/512 |
| 7,156,544 | B2 * | 1/2007 | Ishida | 362/538 |
| 2006/0120094 | A1 * | 6/2006 | Tsukamoto et al. | 362/518 |
| 2007/0177400 | A1 * | 8/2007 | Tatsukawa | 362/514 |
| 2008/0239746 | A1 | 10/2008 | Wuller et al. | |

FOREIGN PATENT DOCUMENTS

| | | | |
|---|---|---|---|
| DE | 10 2005 041 234 | A1 | 3/2007 |
| DE | 60 2004 002 043 | T2 | 4/2007 |
| JP | 04-081337 | A | 3/1992 |
| JP | 2004-231178 | A | 8/2004 |
| JP | 2006-188224 | A | 7/2006 |
| WO | 2007042552 | A1 | 4/2007 |

OTHER PUBLICATIONS

English abstract of DE602004002043 published on Apr. 12, 2007, esp@cenet database, 1 page.
English abstract of DE102005041234 published on Mar. 1, 2007, esp@cenet database, 1 page.
Office Action issued in German Application No. 10 2009 021 046.6-54 dated Nov. 18, 2009 and English translation thereof, 6 pages.
Patent Abstracts of Japan, Publication No. 2004-231178, Publication Date: Aug. 19, 2004, 1 page.
Patent Abstracts of Japan, Publication No. 04-081337, Publication Date: Mar. 16, 1992, 1 page.
Patent Abstracts of Japan, Publication No. 2006-188224, Publication Date: Jul. 20, 2006, 1 page.
Office Action for Korean Application No. 10-2009-0045473 mailed Mar. 29, 2011, with Eglish translation thereof (7 pages).

* cited by examiner

*Primary Examiner* — Robert May
(74) *Attorney, Agent, or Firm* — Osha • Liang LLP

(57) ABSTRACT

In a vehicle headlamp, a light source image forming device forms a first light source image and a second light source image. A projection lens projects the first light source image and the second light source image so as to have a common border with each other. The light source image forming device forms the first light source image and the second light source image at positions spaced apart from each other along respective edges forming the common border.

7 Claims, 7 Drawing Sheets

VEHICLE HEADLAMP

BACKGROUND OF THE INVENTION

1. Field of the Invention

The present invention relates to a vehicle headlamp.

2. Background Art

When driving a vehicle at night, a driver normally turns a headlamps ON so as to irradiate low-beams on a road surface, and turns the headlamps ON so as to irradiate high-beams when needed, to confirm a front side of the vehicle. However, when light is irradiated further above from a so-called cut-off line, a driver of a vehicle traveling ahead or a pedestrian walking ahead may be subjected to a glare. Therefore, there has been proposed a vehicle headlamp which determines a position of a person, for example, forming a mask having a dimension and position corresponding to the person on an image forming device, thereby forming a shadow projected around the person (refer to Patent Document 1, for example). There has also been proposed a vehicle headlamp device which detects the presence or absence of a vehicle traveling ahead, for example, adjusting light so as to reduce light in one direction depending on the detection result, thereby irradiating the thus reduced light to the other direction (refer to Patent Document 2, for example) There has also been proposed a night-vision system for vehicle in which, for example, an object is detected, and, among a plurality of image elements inside a light attenuation matrix, at least light of one image element is attenuated depending on the detection result (refer to Patent Document 3, for example)

[Patent Document 1] JP-A-2004-231178

[Patent Document 2] JP-A-04-081337

[Patent Document 3] JP-A-2006-188224

As disclosed in the above Patent Documents, there has been proposed a technology in which an intermediate member divided into a plurality of partitions capable of switching from light transmittance to light shielding or vice versa is arranged between a light source and a projection lens to mask light irradiated ahead, thereby suppressing glare from being given to people in front. However, where this technology is adopted, a border part between the partitions is less likely to transmit light or emit light than other parts, and the border part may be lit dimly in a projection image.

SUMMARY OF THE INVENTION

One or more embodiments of the invention provide a vehicle headlamp capable of forming a plurality of projection images appropriately having common borders with each other.

In accordance with one or more embodiments of the invention, a vehicle headlamp is provided with: a light source image forming device configured to form a first light source image and a second light source image; and a projection lens configured to project the first light source image and the second light source image so that the first light source image and the second light source image have a common border with each other. The light source image forming device forms the first light source image and the second light source image at positions spaced apart from each other along respective edges which form said common border.

According to the configuration of the vehicle headlamp, the first light source image and the second light source image are first formed at positions spaced apart from each other, thus making it possible to form projection images so as to make the common border less conspicuous. In this instance, where these projection images are spaced apart, there is also conceivable an example in which the first light source image and the second light source image are spaced apart from each other in a manner perpendicular to individual edges forming the common border. In this example, borders can be overlapped on a virtual face of a predetermined distance from a headlamp. However, on a virtual face closer than that or on a virtual face farther than that, edges of individual projection images move in such a direction that are spaced apart or brought closer to the border perpendicularly, by which the edges may not have an appropriate common border. According to the configuration of the embodiments of the invention, even if a distance from the headlamp to the virtual face is changed, a border between adjacent projection images can appropriately be kept in common.

The projection lens may be provided with a first lens portion for projecting the first light source image and a second lens portion for projecting the second light source image. The first lens portion and the second lens portion may be formed in an integrated manner. According to this configuration, it is possible to establish a relative positional relationship between the first lens portion and the second lens portion with high accuracy. Therefore, it is possible to have more appropriately a common border between projection images of both the first light source image and the second light source image.

The vehicle headlamp may be additionally provided with a partition member which is arranged between the first light source image or the second light source image and the projection lens, thereby suppressing light made incident from the first light source image into an incident face of the second lens portion or suppressing light made incident from the second light source image into an incident face of the first lens portion. According to this configuration, light is incident from the first light source image into the incident face of the second lens portion, or light is incident from the second light source image into the incident face of the first lens portion, by which it is possible to suppress light which leaks to parts other than projection images to be formed.

The vehicle headlamp may be additionally provided with a light shielding member which is arranged between the first light source image or the second light source image and the projection lens, thereby suppressing light passing from the first light source image through the incident face of the first lens portion to arrive at an outgoing face of the second lens portion or suppressing light passing from the second light source image through the incident face of the second lens portion to arrive at an outgoing face of the first lens portion.

As described above, where the first lens portion and the second lens portion are formed in an integrated manner, as compared with a case where they are formed separately, it becomes more difficult to install a partition member between them. Therefore, light becomes more easily made incident from the first light source image into the outgoing face of the second lens portion, or light becomes also more easily made incident from the second light source image into the outgoing face of the first lens portion. According to the above configuration, it is possible to suppress light which leaks out in an unintended direction through the above route.

The projection lens may be installed so as to rotate freely at the center of the rotational axis positioned between an optical axis of the first lens portion and that of the second lens portion. According to this configuration, the projection lens is rotated, by which a projection image resulting from the first lens portion and a projection image resulting from the second lens portion can be made to move in a direction which is spaced apart from each other or brought closer to a common border approximately in a perpendicular direction. Thus, it is possible to easily adjust a relative position of their projection images so as to have the common border favorably.

According to the vehicle headlamp of the embodiments of the invention, it is possible to form a plurality of projection images appropriately having common borders with each other.

Other aspects and advantages of the invention will be apparent from the following description, the drawings and the claims.

DETAILED DESCRIPTION OF THE EXEMPLARY EMBODIMENTS

Figure 1:
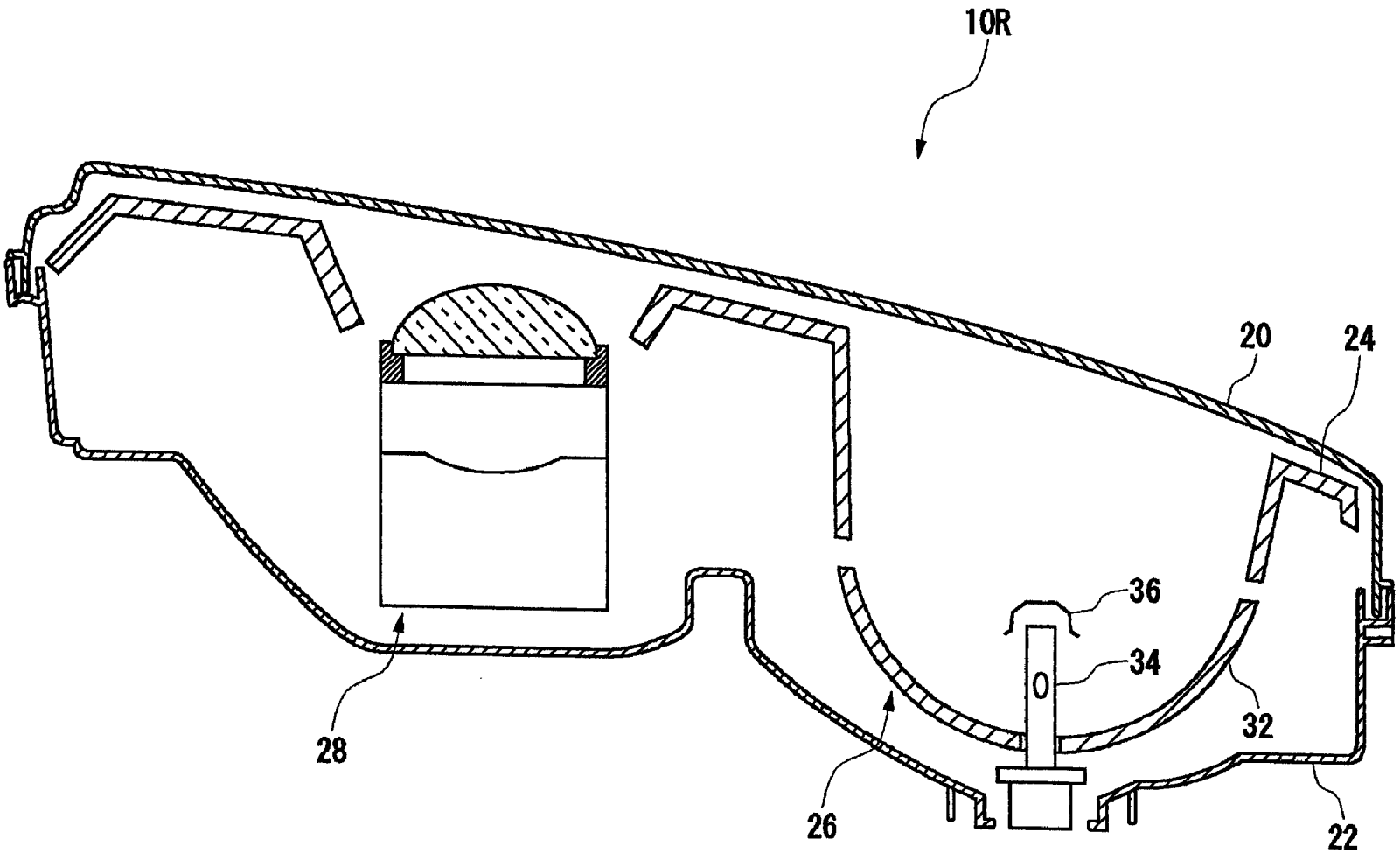
FIG. 1 is a view showing a constitution of a right headlamp unit according to an exemplary embodiment of the invention.

Hereinafter, a detailed description will be given for an exemplary embodiment of the invention (hereinafter, referred to as an embodiment) by referring to the drawings.

FIG. 1 is a view showing a constitution of a right headlamp unit 1R according to the present embodiment. In FIG. 1, for easy understanding, there is shown a cross-sectional view of the right headlamp unit 10R when cut on the horizontal face and viewed from above. The right headlamp unit 10R and a left headlamp unit (not shown, and hereinafter, referred to as the "left headlamp unit 10L") constitute a headlamp unit. It is noted that the left headlamp unit 10L is constituted so as to be symmetrical to the right head lamp unit 10R, and hereinafter, description will be given for the right headlamp unit 10R, thereby omitting description of the left headlamp unit 10L.

The right headlamp unit 10R is provided with a translucent cover 20, a lamp body 22, an extension 24, a first lamp fitting unit 26 and a second lamp fitting unit 28. The lamp body 22 is formed in a cup shape having a long narrow opening portion by using a resin or the like. The translucent cover 20 is formed by using a translucent resin or the like and fitted to the lamp body 22 so as to seal the opening portion of the lamp body 22. Thus, the lamp body 22 and the translucent cover 20 constitute a lamp chamber. Inside the lamp chamber, arranged are the extension 24, the first lamp fitting unit 26 and the second lamp fitting unit 28.

The extension 24 is provided with two opening portions for passing light irradiated from the first lamp fitting unit 26 and the second lamp fitting unit 28. The extension 24 is fixed to the lamp body 22. The first lamp fitting unit 26 is arranged more externally than the second lamp fitting unit 28 in a vehicle. The first lamp fitting unit 26 is a so-called parabola-type lamp fitting unit, forming a low-beam light distribution pattern to be described later.

The first lamp fitting unit 26 is provided with a reflector 32, a light source bulb 34 and a shade 36. The reflector 32 is formed in a cup shape, with an insertion hole made at the center. In the present embodiment, the light source bulb 34 is constituted with a filament-equipped incandescent lamp such as a halogen lamp. It is noted that the light source bulb 34 may be constituted by adopting an electric discharge lamp made up of an HID lamp (also referred to as a discharge lamp) such as a metal halide bulb. The light source bulb 34 is inserted into an insertion hole of the reflector 32 so as to protrude inwardly and fixed to the reflector 32. The reflector 32 is provided with a curved inner face formed so as to reflect light irradiated by the light source bulb 34 toward the front of a vehicle. The shade 36 shields light which advances directly from the light source bulb 34 to the front of a vehicle. Since the first lamp fitting unit 26 is publicly known for the constitution, detailed description of the first lamp fitting unit 26 will be omitted here.

Figure 2:
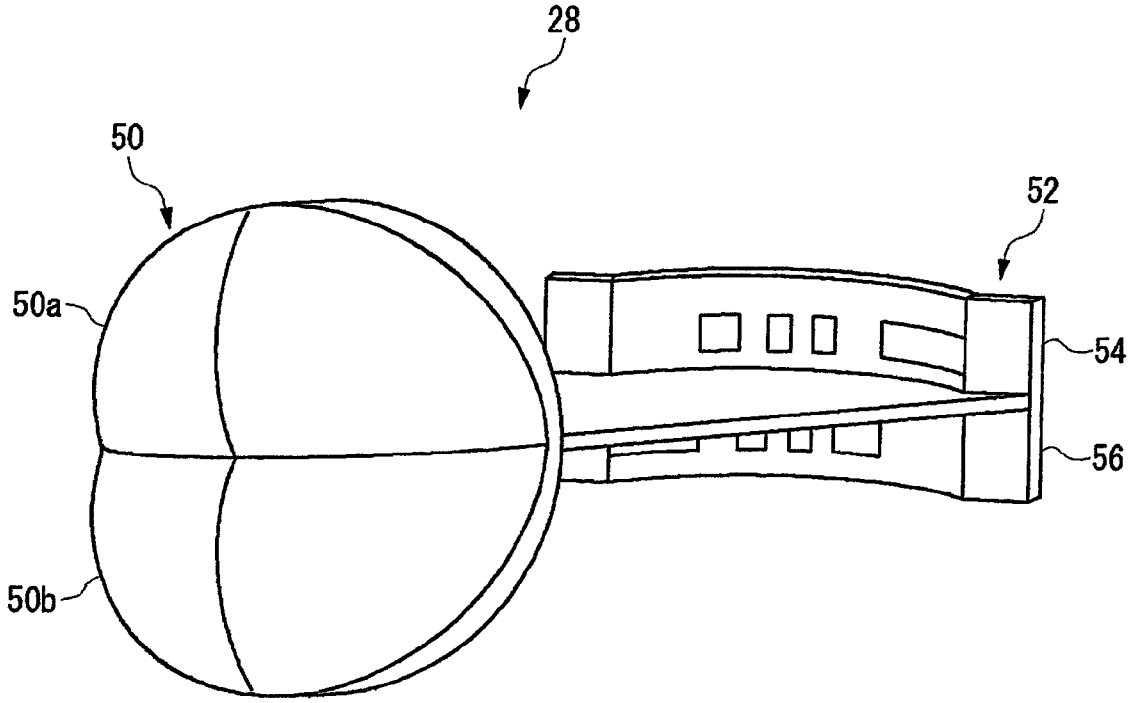
FIG. 2 is a perspective view showing a main constitution of a second lamp fitting unit according to the embodiment.

FIG. 2 is a perspective view showing a main constitution of the second lamp fitting unit 28 according to the present embodiment. The second lamp fitting unit 28 is provided with a projection lens 50 and a light source image forming unit 52. The projection lens 50 is constituted with a first lens portion 50*a* and a second lens portion 50*b*. The first lens portion 50*a* and the second lens portion 50*b* are respectively constituted with a plane-convex aspheric lens in which the surface on the front is a convex face and the surface at the back is planar, projecting a light source image formed on the focal face at the back as a reverted image in front of the lamp fitting. Hereinafter, description will be given on the basis of a projection image formed on a virtual perpendicular screen arranged, for example, at a position of 25 meters in front of a vehicle. It is noted that, as a matter of course, a virtual face on which the projection image is to be formed is not limited to the above-described perpendicular face, and it may be, for example, a horizontal face on which a road surface is assumed. The first lens portion 50*a* and the second lens portion 50*b* are formed in the same shape or formed integrally in a mutually overlapped shape so that their remaining optical axes are substantially in parallel. The projection lens 50 is formed so as to be circular in appearance when viewed from the front. The projection lens 50 is arranged in such a manner that the optical axis of the first lens portion 50*a* is positioned perpendicularly above the optical axis of the second lens portion 50*b*.

The light source image forming unit 52 is provided with a first light source image forming unit 54 and a second light source image forming unit 56. The first light source image forming unit 54 is arranged at an upper part of the second light source image forming unit 56. The first light source image forming unit 54 forms a light source image projected by the first lens portion 50*a*. The second light source image forming unit 56 forms a light source image projected by the second lens portion 50*b*.

Figure 3:
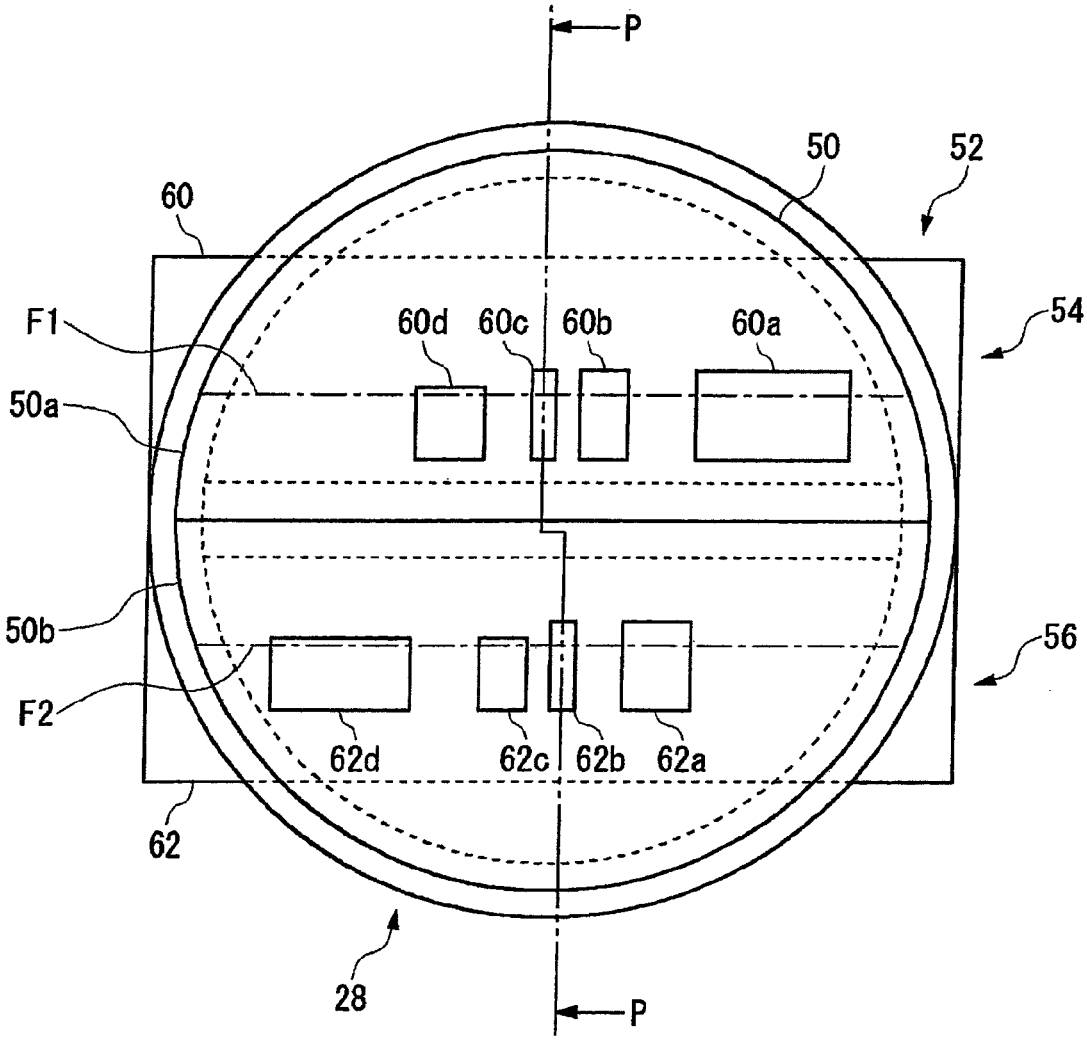
FIG. 3 is a view of the second lamp fitting unit according to the embodiment when viewed from a front side.

FIG. 3 is a view of the second lamp fitting unit 28 according to the present embodiment when viewed from the front. The first light source image forming unit 54 is provided with a first light guiding member 60 opposing a planar portion of the projection lens 50. The first light guiding member 60 is provided with an upper first light guiding channel 60*a* to an upper fourth light guiding channel 60*d*, each of which has a rectangular opening portion. In order from right to left when viewed from the front, the respective opening portions of the upper first light guiding channel 60*a* to the upper fourth light guiding channel 60*d* are installed together at intervals in the horizontal direction. The upper first light guiding channel 60*a* to the upper third light guiding channel 60*c* are formed so as to be equal to each other in height at the respective opening portions. The upper fourth light guiding channel 60*d* is formed so as to be lower in height at the opening portion than the upper first light guiding channel 60*a* to the upper third light guiding channel 60*c*. Further, these light guiding channels are formed in such a manner that the upper first light guiding channel 60*a* is the greatest in width at the opening portion, the upper fourth light guiding channel 60*d* is the second greatest in width at the opening portion, the upper second light guiding channel 60*b* is the third greatest in width at the opening portion and the upper third light guiding channel 60*c* is the smallest in width at the opening portion.

The respective opening portions of the upper first light guiding channel 60*a* to the upper fourth light guiding channel 60*d* are used as light source images, and the images of the opening portions are projected forward through the first lens portion 50*a*. Therefore, the first light guiding member 60 functions as a light source image forming member which forms a light source image to be projected.

The second light source image forming unit 56 is provided with a second light guiding member 62 opposing the projection lens 50. The second light guiding member 62 is provided with a lower first light guiding channel 62*a* to a lower fourth light guiding channel 62*d*, each of which has a rectangular opening portion. In order from right to left when viewed from the front, the respective opening portions of the lower first light guiding channel 62*a* to the lower fourth light guiding channel 62*d* are installed together at intervals in the horizontal direction. The lower first light guiding channel 62*a* and the lower second light guiding channel 62*b* are formed so as to be equal in height at the respective opening portions. The lower third light guiding channel 62*c* and the lower fourth light guiding channel 62*d* are formed so as to be equal in height at the opening portion and also lower in height at the opening portion than the lower first light guiding channel 62*a* to the lower second light guiding channel 62*b*. Further, these light guiding channels are formed in such a manner that the lower fourth light guiding channel 62*d* is the greatest in width at the opening portion, the lower first light guiding channel 62*a* is the second greatest in width at the opening portion, the lower third light guiding channel 62*c* is the third greatest in width at the opening portion, the lower second light guiding channel 62*b* is the smallest in width at the opening portion.

The respective opening portions of the lower first light guiding channel 62*a* to the lower fourth light guiding channel 62*d* are used as light source images, and the images of the opening portions are projected forward through the second lens portion 50*b*. Therefore, the second light guiding member 62 also functions as a light source image forming member which forms a light source image to be projected.

The light source image forming unit 52 projects projection images resulting from eight light source images of the respective opening portions of the upper first light guiding channel 60*a* to the upper fourth light guiding channel 60*d* and of the respective opening portions of the lower first light guiding channel 62*a* to the lower fourth light guiding channel 62*d* on a virtual perpendicular screen so as to have common borders between mutually adjacent projection images. The light source image forming unit 52 forms these eight light source images at positions spaced apart from each other along individual edges forming the common borders. More specifically, the light source image forming unit 52 forms, at positions spaced apart from each other vertically along the edges extending in a perpendicular direction, the respective opening portions of the upper first light guiding channel 60*a* to the upper fourth light guiding channel 60*d* and the respective opening portions of the lower first light guiding channel 62*a* to the lower fourth light guiding channel 62*d*. Thereby, even if there is changed a distance from the headlamp unit 10 to the virtual perpendicular screen, it is possible to keep a state where borders between adjacent projection images are favorably overlapped.

Figure 7:
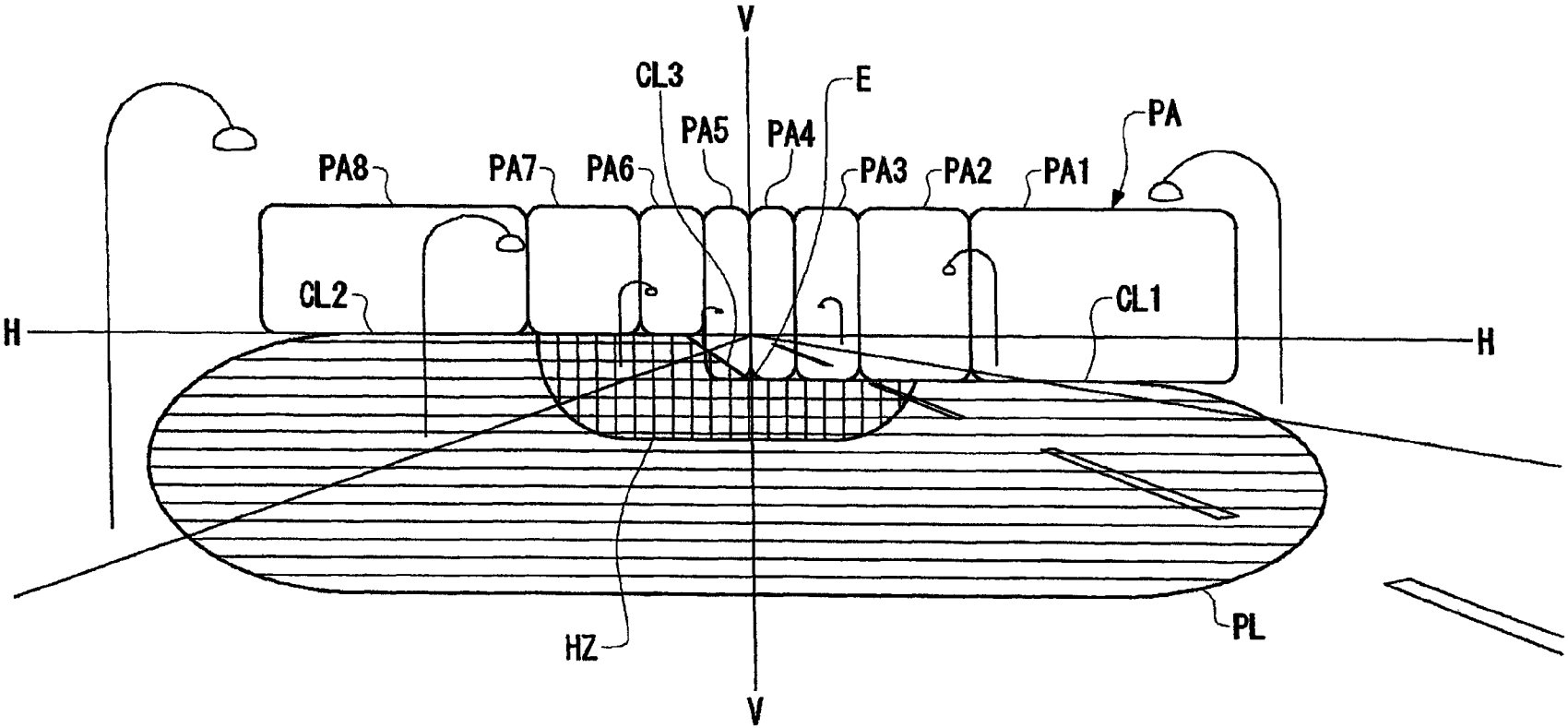
FIG. 7 is a view showing a light distribution pattern formed on a virtual perpendicular screen by the right headlamp unit and the left headlamp unit according to the embodiment.

For example, the light source image 60*a* by the upper first light guiding channel 60*a* shown in FIG. 3 passes through the projection lens 50 to form a first part region PA1 in a light distribution pattern shown in FIG. 7, and the light source image 62*a* by the lower first light guiding channel 62*a* shown in FIG. 3 passes through the projection lens 50 to form a second part region PA2 in the light distribution pattern shown in FIG. 7. A border between the first part region PA1 and the second part region PA2 corresponds to one of the above common borders. The common border between the first part region PA1 and the second part region PA2 positions in a left edge of the first part region PA1 and in a right edge of the second part region PA2. An edge for forming the common border in the light source image 60*a* by the upper first light guiding channel 60*a* is positioned on a left edge in the light source image 60*a*. An edge for forming the common border in the light source image 62*a* by the lower first light guiding channel 62*a* is positioned on a right edge in the light source image 62*a*. As shown in FIG. 3, the light source image 60*a* by the upper first light guiding channel 60*a* and the light source image 62*a* by the lower first light guiding channel 62*a* are apart from each other along a direction in which the left edge of the light source image 60*a* extends and the right edge of the light source image 62*a* extends.

The upper first light guiding channel 60*a* to the upper fourth light guiding channel 60*d* are arranged in such a manner that the locus at a backward focal point F1 of the first lens portion 50*a* passes over an upper part of the respective opening portions. Further, the lower first light guiding channel 62*a* to the lower fourth light guiding channel 62*d* are arranged in such a manner that the locus at a backward focal point F2 of the second lens portion 50*b* passes over the upper part of the respective opening portions. In a light source image, a part closer to the focal point of the lens forms a projection image at a greater brightness than a part distant therefrom. Therefore, the focal point of the projection lens 50 is arranged as in the present embodiment, by which a projection image with an increasing brightness as it proceeds downward can be formed on the virtual perpendicular screen, thereby suppressing a decrease in illumination intensity in the vicinity of the horizontal line.

Figure 4:
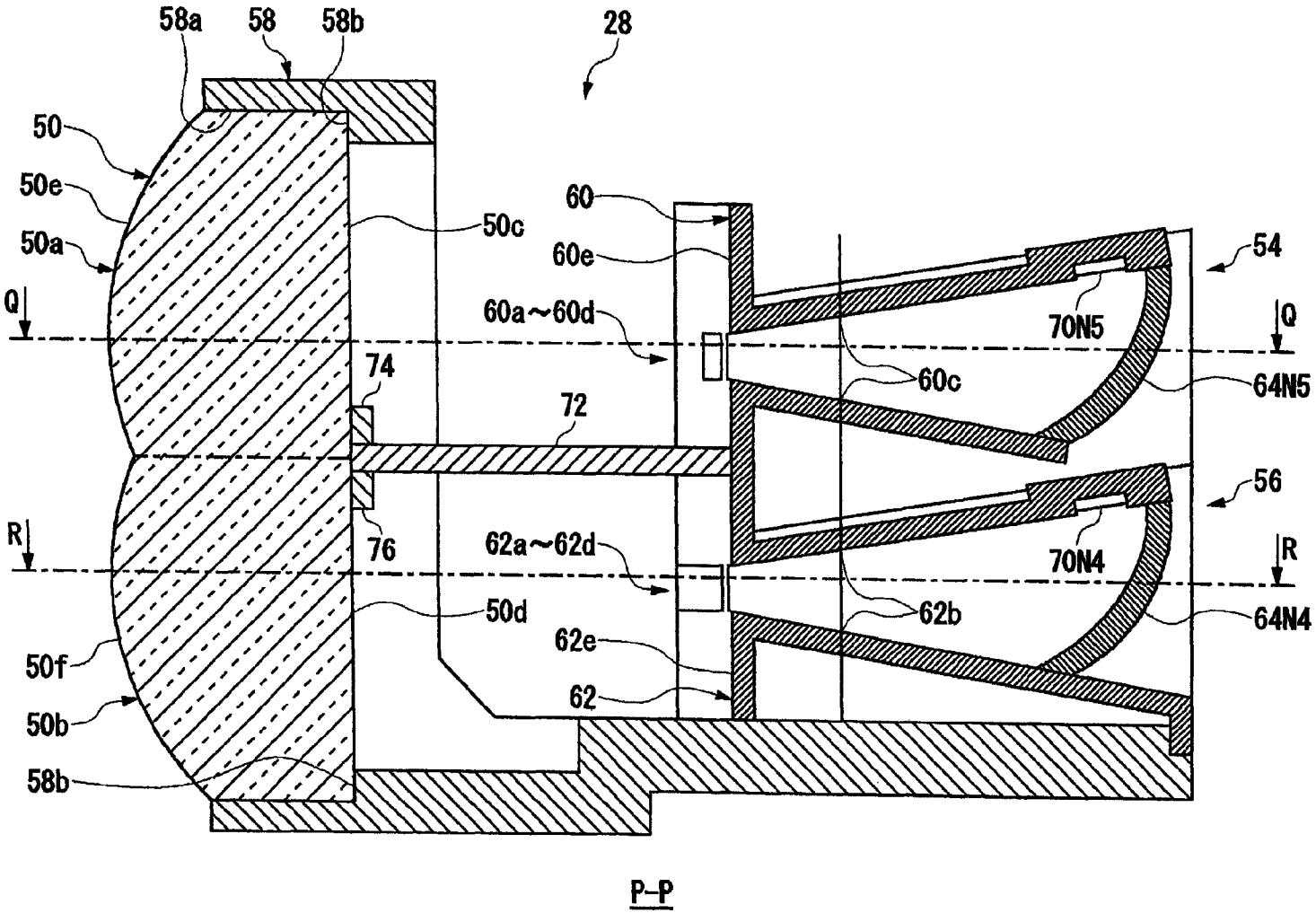
FIG. 4 is a cross-sectional view taken along the line P-P in FIG. 3.

FIG. 4 is a cross-sectional view taken along the line P-P in FIG. 3. The second lamp fitting unit 28 is additionally provided with a holder 58, a partition member 72, an upper light shielding member 74 and a lower light shielding member 76. The holder 58 is provided with an annular lens fitting portion 58*a*, the inner diameter of which is approximately equal to the outer diameter of the projection lens 50. Behind the lens fitting portion 58*a*, there is installed a lock portion 58*b* protruding radially inwardly from the lens fitting portion 58*a*. The projection lens 50 is fitted into the lens fitting portion 58*a* until the planar portion thereof butts against the lock portion 58*b* and fixed thereto. Hereinafter, the planar portion of the first lens portion 50*a* is referred to as a first incident face 50*c*, and the planar portion of the second incident face 50*d* is referred to as a second incident face 50*d*. Further, the convex curved face portion of the first lens portion 50*a* is referred to as a first outgoing face 50*e*, and the convex curved face portion of the second lens portion 50*b* is referred to as a second outgoing face 50*f*. It is noted that a border between the first incident face 50*c* and the second incident face 50*d* is a line which is projected perpendicularly on the planar portion of the back face from a line formed at a valley formed between the first outgoing face 50*e* and the second outgoing face 50*f*.

In this instance, for example, the second lens portion 50*b* projects forward the respective projection images at the opening portions of the lower first light guiding channel 62*a* to the lower fourth light guiding channel 62*d*. Therefore, where light is made incident into the second incident face 50*d* from any one of the upper first light guiding channel 60*a* to the upper fourth light guiding channel 60*d*, the light is irradiated toward a part other than an image to be projected. This is also true for a case where light is made incident into the first incident face 50*c* from any one of the lower first light guiding channel 62*a* to the lower fourth light guiding channel 62*d*.

Therefore, at the second lamp fitting unit 28 installed is a partition member 72. The partition member 72 is installed so as to extend from a border line between the first incident face 50*c* and the second incident face 50*d* to the front face of the light source image forming unit 52. In this instance, the partition member 72 is butted between the opening portions of the upper first light guiding channel 60*a* to the upper fourth light guiding channel 60*d* and the opening portions of the lower first light guiding channel 62*a* to the lower fourth light guiding channel 62*d*. The surface of the partition member 72 is subjected to anti-reflection treatment for suppressing the reflection of light. Thus, the partition member 72 suppresses light made incident into the second incident face 50*d* from the respective opening portions of the upper first light guiding channel 60*a* to the upper fourth light guiding channel 60*d*. The partition member 72 also suppresses light made incident into the first incident face 50*c* from the respective opening portions of the lower first light guiding channel 62*a* to the lower fourth light guiding channel 62*d*. Thereby, it is possible to suppress light which leaks out in an unintended direction.

Further, in the present embodiment, the first lens portion 50*a* and the second lens portion 50*b* are formed in an integrated manner. Therefore, it is difficult to arrange a light shielding member between the first lens portion 50*a* and the second lens portion 50*b*. On the other hand, for example, where light irradiated from any one of the opening portions of the upper first light guiding channel 60*a* to the upper fourth light guiding channel 60*d* passes through the first incident face 50*c* and thereafter arrives at the second outgoing face 50*f* instead of the first outgoing face 50*e*, the light will leak out toward a part different from an image to be projected. This is also true for a case where light irradiated from any one of the opening portions of the lower first light guiding channel 62*a* to the lower fourth light guiding channel 62*d* passes through the second incident face 50*d* and thereafter arrives at the first outgoing face 50*e* instead of the second outgoing face 50*f*.

Therefore, at the second lamp fitting unit 28 installed are an upper light shielding member 74 and a lower light shielding member 76. The upper light shielding member 74 is arranged in contact with the first incident face 50*c* so as to protrude upward in a predetermined height from a border line between the first incident face 50*c* and the second incident face 50*d*. In the present embodiment, the upper light shielding member 74 is to be uniform in height all over across the border line between the first incident face 50*c* and the second incident face 50*d*. It is noted that the upper light shielding member 74 may have a curved-line shaped upper edge in which the height from the border line between the first incident face 50*c* and the second incident face 50*d* is made greater as it moves closer to the center in a lateral direction. The surface of the upper light shielding member 74 is also subjected to anti-reflection treatment. The upper light shielding member 74 suppresses light which passes from the respective opening portions of the upper first light guiding channel 60*a* to the upper fourth light guiding channel 60*d* through the first incident face 50*c*, arriving at the second outgoing face 50*f*.

The lower light shielding member 76 is arranged in contact with the second incident face 50*d* so as to protrude downward in a predetermined height from the border line between the first incident face 50*c* and the second incident face 50*d*. In the present embodiment, the lower light shielding member 76 is to be uniform in height all over across the border line between the first incident face 50*c* and the second incident face 50*d*. It is noted that the lower light shielding member 76 may have a curved-line shaped lower edge in which the height from the border line between the first incident face 50*c* and the second incident face 50*d* is made greater as it moves closer to the center in the lateral direction. The surface of the lower light shielding member 76 is also subjected to anti-reflection treatment. The lower light shielding member 76 suppresses light which passes from the respective opening portions of the lower first light guiding channel 62*a* to the lower fourth light guiding channel 62*d* through the second incident face 50*d*, arriving at the first outgoing face 50*e*. Thereby, it is possible to suppress light that leaks out in an unintended direction.

As described above, the lock portion 58*b* protrudes radially inwardly from the lens fitting portion 58*a*. Therefore, the lock portion 58*b* suppresses light that passes from the respective opening portions of the upper first light guiding channel 60*a* to the upper fourth light guiding channel 60*d* and those of the lower first light guiding channel 62*a* to the lower fourth light guiding channel 62*d*, arriving at an edge of the projection lens 50. Thereby, it is possible to suppress light which is reflected at the edge of the projection lens 50 to leak out in an unintended direction.

FIG. 4 shows a cross section of the upper third light guiding channel 60*c* and that of the lower second light guiding channel 62*b*, as an example. As shown in FIG. 4, on the upper inner face of the upper third light guiding channel 60*c* installed is a fifth light-emitting device 70N5, and on the upper inner face of the lower second light guiding channel 62*b* installed is a fourth light-emitting device 70N4. Hereinafter, a detailed description will be given for a constitution of the first light source image forming unit 54 by referring to FIG. 5, and a detailed description will also be given for a constitution of the second light source image forming unit 56 by referring to FIG. 6.

Figure 5:
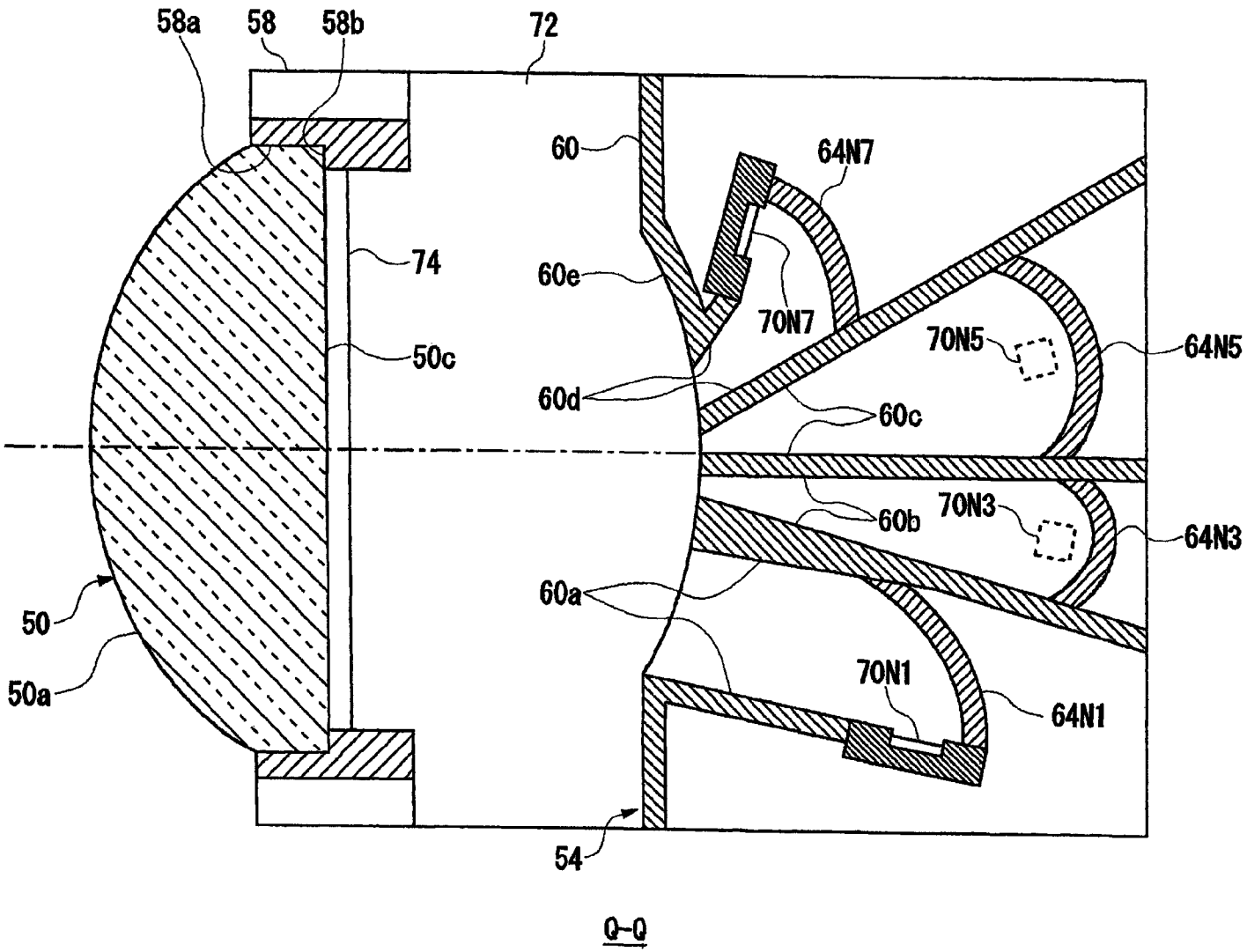
FIG. 5 is a cross-sectional view taken along the line Q-Q in FIG. 4.

FIG. 5 is a cross-sectional view taken along the line Q-Q in FIG. 4. More specifically, FIG. 5 shows a cross-sectional view of the first light source image forming unit 54 when cut by a horizontal face including the optical axis of the first lens portion 50*a*. The first light source image forming unit 54 is additionally provided with a first light-emitting device 70N1, a third light-emitting device 70N3, a fifth light-emitting device 70N5, a seventh light-emitting device 70N7, a first reflector 64N1, a third reflector 64N3, a fifth reflector 64N5 and a seventh reflector 64N7.

As will be described later, the second light source image forming unit 56 is provided with a second light-emitting device 70N2, a fourth light-emitting device 70N4, a sixth light-emitting device 70N6 and an eighth light-emitting device 70N8. Hereinafter, the first light-emitting device 70N1 to the eighth light-emitting device 70N8 are collectively referred to as "light-emitting devices 70," whenever necessary. Each of the light-emitting devices 70 is provided with a light-emitting chip (not shown) and a thin film. The light-emitting chip is constituted with a white light emitting diode having an approximately 1 mm-square light-emitting face. As a matter of course, the light-emitting chip shall not be limited to the above-described light emitting diode and may include, for example, other element-like light sources which effect surface light emission approximately in a spot-light manner like a laser diode. The thin film is installed so as to cover the light-emitting face of the light-emitting chip.

The first light guiding member 60 is provided with a front face 60*e* on an outer face which faces to the projection lens 50. The front face 60*e* is recessed in a circular arc shape, facing backward so as to follow the locus of the backward focal point of the projection lens 50. It is noted that the front face 60*e* may be planar. Each of the upper first light guiding channel 60*a* to the upper fourth light guiding channel 60*d* is provided with an opening portion on the front face 60*e*. The upper first light guiding channel 60*a* is formed so as to be approximately equal in lateral width even when moving backward from the opening portion on the front face 60*e*. The upper second light guiding channel 60*b* to the upper fourth light guiding channel 60*d* are formed so as to increase in lateral width as they move backward from the opening portion on the front face 60*e*. The opening portion behind the upper first light guiding channel 60*a* is sealed by the first reflector 64N1, and the opening portion behind the upper second light guiding channel 60*b* is sealed by the third reflector 64N3. Further, the opening portion behind the upper third light guiding channel 60*c* is sealed by the fifth reflector 64N5, and the opening portion behind the upper fourth light guiding channel 60*d* is sealed by the seventh reflector 64N7.

The upper first light guiding channel 60*a* is provided on the left inner face with the first light-emitting device 70N1. Light irradiated by the first light-emitting device 70N1 is reflected on the inner face of the first reflector 64N1, forming a light source image resulting from the opening portion of the upper first light guiding channel 60*a*. The upper second light guiding channel 60*b* is provided on the upper inner face with the third light-emitting device 70N3. Light irradiated by the third light-emitting device 70N3 is reflected on the inner face of the third reflector 64N3, forming a light source image resulting from the opening portion of the upper second light guiding channel 60*b*. The upper third light guiding channel 60*c* is provided on the upper inner face with the fifth light-emitting device 70N5. Light irradiated by the fifth light-emitting device 70N5 is reflected on the inner face of the fifth reflector 64N5, forming a light source image resulting from the opening portion of the upper third light guiding channel 60*c*. The upper fourth light guiding channel 60*d* is provided on the right inner face with the seventh light-emitting device 70N7. Light irradiated by the seventh light-emitting device 70N7 is reflected on the inner face of the seventh reflector 64N7, forming a light source image resulting from the opening portion of the upper fourth light guiding channel 60*d*.

The upper first light guiding channel 60*a* to the upper fourth light guiding channel 60*d* are subjected to aluminum evaporation all over across the inner face, thereby raising the reflection rate of light. It is noted that in place of aluminum, silver may be used for evaporation. As described above, the inner face of the light guiding channel is treated by evaporation to raise the reflection rate of light, thus making it possible to increase the brightness of light reflected on the inner face of the light guiding channel toward the projection lens 50.

Figure 6:
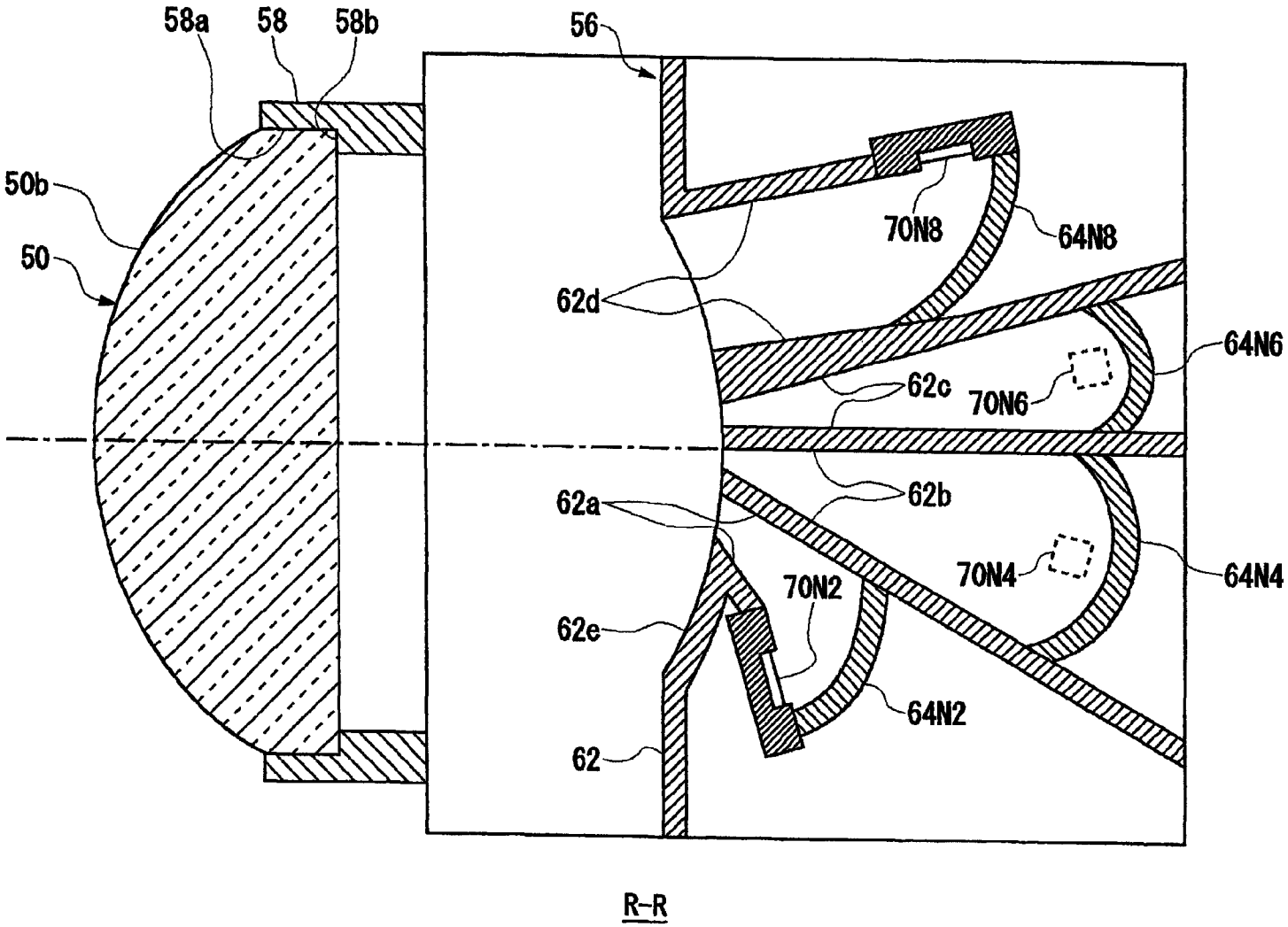
FIG. 6 is a cross-sectional view taken along the line R-R in FIG. 4.

FIG. 6 is a cross-sectional view taken along the line R-R in FIG. 4. More specifically, FIG. 6 shows a cross-sectional view of the second light source image forming unit 56 when cut by a horizontal face including the optical axis of the second lens portion 50*b*. The second light source image forming unit 56 is additionally provided with a second light-emitting device 70N2, a fourth light-emitting device 70N4, a sixth light-emitting device 70N6, an eighth light-emitting device 70N8, a second reflector 64N2, a fourth reflector 64N4, a sixth reflector 64N6 and an eighth reflector 64N8.

The second light guiding member 62 is provided with a front face 62*e* on an outer face which faces to the projection lens 50. The front face 62*e* is recessed in a circular arc shape, facing backward so as to follow the locus of the backward focal point of the projection lens 50. It is noted that the front face 62*e* may be planar. Each of the lower first light guiding channel 62*a* to the upper fourth light guiding channel 60*d* is provided with an opening portion on the front face 62*e*. The lower first light guiding channel 62*a* to the lower fourth light guiding channels 62*d* are formed so as to expand in lateral width as they move backward from the opening portion on the front face 62*e*. The lower fourth light guiding channel 62*d* is formed so as to be approximately equal in lateral width even when moving backward from the opening portion on the front face 62*e*. The opening portion behind the lower first light guiding channel 62*a* is sealed by the second reflector 64N2, and the opening portion behind the lower second light guiding channel 62*b* is sealed by the fourth reflector 64N4. Further, the opening portion behind the lower third light guiding channel 62*c* is sealed by the sixth reflector 64N6, and the opening portion behind the lower fourth light guiding channel 62*d* is sealed by the eighth reflector 64N8.

The lower first light guiding channel 62*a* is provided on the left inner face with the second light-emitting device 70N2. Light irradiated by the second light-emitting device 70N2 is reflected on the inner face of the second reflector 64N2, forming a light source image resulting from the opening portion of the lower first light guiding channel 62*a*. The lower second light guiding channel 62*b* is provided on the upper inner face with the fourth light-emitting device 70N4. Light irradiated by the fourth light-emitting device 70N4 is reflected on the inner face of the fourth reflector 64N4, forming a light source image resulting from the opening portion of the lower second light guiding channel 62*b*. The lower third light guiding channel 62*c* is provided on the upper inner face with the sixth light-emitting device 70N6. Light irradiated by the sixth light-emitting device 70N6 is reflected on the inner face of the sixth reflector 64N6, forming a light source image resulting from the opening portion of the lower third light guiding channel 62*c*. The lower fourth light guiding channel 62*d* is provided on the right inner face with the eighth light-emitting device 70N8. Light irradiated by the eighth light-emitting device 70N8 is reflected on the inner face of the eighth reflector 64N8, forming a light source image resulting from the opening portion of the lower fourth light guiding channel 62*d*.

The lower first light guiding channel 62*a* to the lower fourth light guiding channel 62*d* are subjected to aluminum evaporation all over across the inner face, thereby raising the reflection rate of light, which is the same as the case of the upper first light guiding channel 60*a* to the upper fourth light guiding channel 60*d*. In place of aluminum, silver may be used for evaporation, which is also the same as the above case.

FIG. 7 is a view showing a light distribution pattern formed on a virtual perpendicular screen by the right headlamp unit 10R and the left headlamp unit 10L according to the present embodiment.

A low-beam light distribution pattern PL is formed by the first lamp fitting unit 26. The low-beam light distribution pattern PL is a low-beam light distribution pattern of left light distribution, having at the upper edge a first cut-off line CL1 to a third cut-off line CL3. The first cut-off line CL1 to the third cut-off line CL3 extend in a horizontal direction, with a step given to the right side and the left side starting from the line V to V, which is a perpendicular line passing through H to V, a vanishing point in the front direction of the lamp fitting. The first cut-off line CL1 extends in the horizontal direction on the right side from the line V to V and also downward from the line H to H. Therefore, the first cut-off line CL1 is used as an opposite direction cut-off line. The third cut-off line CL3 extends diagonally at an inclined angle of 15° from the left edge of the first cut-off line CL1 toward upward on the left side. The second cut-off line CL2 extends on the line H to H on the left side from an intersecting point of the third cut-off line CL3 with the line H to H. Therefore, the second cut-off line CL2 is used as a cut-off line on the line of its own vehicle. In the low-beam light distribution pattern PL, an elbow point E, which is an intersecting point of the first cut-off line CL1 with the line V to V, is positioned below at approximately 0.5 to 0.6° from H-V, and a hot zone HZ, that is a region greater in light intensity, is formed so as to enclose the elbow point E somewhat to the left side.

The left headlamp unit 10L is also provided with the first lamp fitting unit 26 and the second lamp fitting unit 28. The low-beam light distribution pattern PL is formed by light irradiated from the first lamp fitting unit 26 of the right headlamp unit 10R which is overlapped with light irradiated from the first lamp fitting unit 26 of the left headlamp unit 10L. Therefore, these first lamp fitting units 26 function as low-beam light sources for forming the low-beam light distribution pattern PL. Further, an additional light distribution pattern PA is formed by light irradiated from the second lamp fitting unit 28 of the right headlamp unit 10R which is overlapped with light irradiated from the second lamp fitting unit 28 of the left headlamp unit 10L. Therefore, the second lamp fitting units 28 function as additional light sources for forming the additional light distribution pattern PA. It is noted that the second lamp fitting units 28 may function as high-beam light sources for forming a so-called high-beam light distribution pattern.

The additional light distribution pattern PA is formed in a band shape so as to extend in a horizontal direction including the horizontal line. The additional light distribution pattern PA is set so as to have the upper end at a position above 5°, with a step given to the lower end so as to be in contact with the first cut-off line CL1 and the second cut-off line CL2. The right and left ends are set to be positioned respectively at 200 on the right and left sides.

The additional light distribution pattern PA is constituted with eight rectangular regions divided and arranged in the horizontal direction. Hereinafter, these regions are sequentially from the right side referred to as a first part region PA1 to an eighth part region PA8 and a border between adjacent part regions is referred to as a division line. A division line between the fourth part region PA4 and the fifth part region PA5 is set to be 0°. A division line between the third part region PA3 and the fourth part region PA4 is set to be 2° on the right side, and a division line between the fifth part region PA5 and the sixth part region PA6 is set to be 2° on the left side. A division line between the second part region PA2 and the third part region PA3 is set to be 4° on the right side, and a division line between the sixth part region PA6 and the seventh part region PA7 is set to be 4° on the left side. A division line between the first part region PA1 and the second part region PA2 is set to be 8° on the right side, and a division line between the seventh part region PA7 and the eighth part region PA8 is set to be 8° on the left side. It is noted that a division line may be positioned at an angle other than those described above. Further, the part regions are not limited to rectangular regions but may include, for example, a trapezoid, a parallelogram, or other shapes.

In the present embodiment, the division line is a line having some width, and adjacent part regions overlap each other only by this line width, thereby forming the additional light distribution pattern PA. More specifically, the respective opening portions of the upper first light guiding channel 60*a* to the upper fourth light guiding channel 60*d* and the respective opening portions of the lower first light guiding channel 62*a* to the lower fourth light guiding channel 62*d* are provided with a width slightly greater than the width based on a part region to be formed. Thereby, realized is formation of the additional light distribution pattern PA in which adjacent part regions overlap each other when projected on a virtual perpendicular screen. As described above, the part regions are overlap each other, thus making it possible to avoid the reduction of division lines in illumination intensity.

The first part region PA1 is formed as a projection image in which the opening portion of the upper first light guiding channel 60*a* is given as a light source image. The second part region PA2 is formed as a projection image in which the opening portion of the lower first light guiding channel 62*b* is given as a light source image. The third part region PA3 is formed as a projection image in which the opening portion of the upper second light guiding channel 60*b* is given as a light source image. The fourth part region PA4 is formed as a projection image in which the opening portion of the lower second light guiding channel 62*b* is given as a light source image. The fifth part region PA5 is formed as a projection image in which the opening portion of the upper third light guiding channel 60*c* is given as a light source image. The sixth part region PA6 is formed as a projection image in which the opening portion of the lower third light guiding channel 62*c* is given as a light source image. The seventh part region PA7 is formed as a projection image in which the opening portion of the upper fourth light guiding channel 60*d* is given as a light source image. The eighth part region PA8 is formed as a projection image in which the opening portion of the lower fourth light guiding channel 62*d* is given as a light source image. Each of the light-emitting devices 70 installed on the upper first light guiding channel 60*a* to the upper fourth light guiding channel 60*d* and on the lower first light guiding channel 62*a* to the lower fourth light guiding channel 62*d* functions as a light source individually forming each of a plurality of part regions formed by dividing the additional light distribution pattern PA.

A vehicle (not shown) on which the headlamp unit 10 is loaded is provided with not only a publicly known high-beam switch (not shown) but also an intermediate beam switch (not shown). The intermediate beam switch is turned on by a user to start an intermediate beam mode. In the intermediate beam mode, of the first part region PA1 to the eighth part region PA8, a light-emitting device 70 forming a part region which illuminates vehicles traveling ahead such as oncoming vehicles and leading vehicles is turned off, thereby suppressing glare given to drivers of the vehicles traveling ahead.

More specifically, a vehicle on which the headlamp unit 10 is loaded is provided with a camera (not shown) and a controller (not shown). The controller is provided with a CPU for performing various types of calculation processing, a ROM for accommodating various types of control programs, a RAM used as a work area for accommodating data and executing programs or others, thereby controlling light irradiated by the headlamp unit 10. The camera is, for example, provided with image pick-up devices such as a CCD (charge coupled device) sensor and a COMS (complementary metal oxide semiconductor) sensor, picking up images in front of a vehicle, thereby generating image data. The camera is connected to the controller, thereby outputting the thus generated image data into the controller.

When the intermediate beam switch is turned on by a user, an intermediate beam-on signal is output into the controller, and the controller starts to control light irradiated by a head lamp unit in an intermediate beam mode. In the intermediate beam mode, the controller analyzes the image data input from the camera, thereby making a determination on whether or not a vehicle traveling ahead is found, for example, an oncoming vehicle in which the headlamp thereof is kept on. Where such a vehicle traveling ahead is found, the controller utilizes the position of the headlamp obtained by the analysis to identify the position of the oncoming vehicle. Since a technology of utilizing image data to identify the position of a vehicle traveling ahead as described above is publicly known, description thereof will be omitted here. The controller utilizes the thus identified position of the vehicle traveling ahead, thereby making a determination on whether or not the vehicle traveling ahead is found in any of the first part region PA1 to the eighth part region PA8. Where the vehicle traveling ahead is found in any of the part regions, the controller makes a light-emitting device 70 forming the part region concerned to turn off. It is noted that in place of the light-emitting device 70 which is made to turn off, the controller may control the lighting of the light-emitting device 70 in such a manner that the brightness of irradiated light forming a part region which is determined that a vehicle traveling ahead is found is made lower than the brightness which is determined that no vehicle is found.

The present invention shall not be limited to the above-described exemplary embodiment and an embodiment obtained by appropriately combining respective components of the embodiment is also valid as an embodiment of the present invention. It is also possible to add modifications such as various types of changes in design based on knowledge of those skilled in the art to the embodiment. An embodiment to which such modifications are added may be included in the scope of the present invention. Such examples will be described hereinafter.

In a certain modified example, a projection lens 50 is installed so as to rotate freely at the center of a rotational axis positioned between the optical axis of a first lens portion 50*a* and the optical axis of a second lens portion 50*b*. In this instance, the projection lens 50 is fitted and inserted into a lens fitting portion 58*a* so as to rotate freely. At a part of the first lens portion 50*a*, a gear portion indented in parallel with the optical axis is installed at a part of the planar portion. There is installed a gear which is meshed with the gear portion and supported by a holder 58 so as to rotate freely. The gear is coupled to an adjustment knob. The adjustment knob is rotated, by which the projection lens 50 is rotated via the gear with respect to the holder 58. Thereby, it is possible to easily adjust a relative positional relationship in the lateral direction between projection images resulting from the respective opening portions of the upper first light guiding channel 60*a* to the upper fourth light guiding channel 60*d* and projection images resulting from the respective opening portions of the lower first light guiding channel 62*a* to the lower fourth light guiding channel 62*d*. Therefore, adjacent projection images are able to have appropriately a common border with each other.

The positional relationship of projection images is normally adjusted in a final process before product shipment of the headlamp units 10. Therefore, for example, where both the projection lens 50 and the holder 58 are made with a resin, they are melted and fixed after adjustment of the positional relationship of projection images, by which they are fixed to each other so that the projection lens 50 will not rotate with respect to the holder 58 before the product shipment. For example, where the projection lens 50 is made with glass, after adjustment of the positional relationship of projection images, the projection lens 50 and the holder 58 are adhered at a joint portion and fixed to each other so that the projection lens 50 will not rotate with respect to the holder 58 before the product shipment. Thereby, it is possible to avoid the deviated positional relationship of projection images after the product shipment.

In another modified example, in place of a first light guiding member 60, a second light guiding member 62 and light-emitting devices 70 arranged inside them, a plurality of light-emitting devices are arranged on a focal face at the back of the projection lens 50. The fact that each of the plurality of light-emitting devices is provided with a light-emitting chip and a thin film is the same as the above-described case. These light-emitting devices are formed in the same shape as the respective opening portions of the upper first light guiding channel 60*a* to the upper fourth light guiding channel 60*d* and the respective opening portions of the lower first light guiding channel 62*a* to the lower fourth light guiding channel 62*d* and arranged at the same positions. As described above, in place of the light guiding members, light-emitting devices are provided and these light-emitting devices are used to form directly a light source image, thus making it possible to form the additional light distribution pattern PA divided into a plurality of part regions.

Instill another modified example, an upper light shielding member 74 and a lower light shielding member 76 are deleted. Thereby, it is possible to reduce the costs of the upper light shielding member 74 and the lower light shielding member 76.

DESCRIPTION OF REFERENCE NUMERALS AND SIGNS

10R: right headlamp unit
28: second lamp fitting unit
50: projection lens
50*a*: first lens portion
50*b*: second lens portion
50*c*: first incident face
50*d*: second incident face
50*e*: first outgoing face
50*f*: second outgoing face
52: light source image forming unit
54: first light source image forming unit
56: second light source image forming unit
60: first light guiding member
62: second light guiding member
70N1 to 70N8: light-emitting device
72: partition member
74: upper light shielding member
76: lower light shielding member

What is claimed is:

1. A vehicle headlamp comprising:

a light source image forming device configured to form a first light source image and a second light source image; and a projection lens configured to project the first light source image and the second light source image to form a light distribution pattern, so that a first region of the light distribution pattern formed by projecting the first light source image and a second region of the light distribution pattern formed by projecting the second light source image have a common border with each other that extends in a common border direction, wherein the light source image forming device is configured to form the first light source image and the second light source image at positions spaced apart from each other along the common border direction;

wherein the common border direction is vertical with respect to a vehicle.

2. The vehicle headlamp according to claim 1, wherein the projection lens comprises a first lens portion for projecting the first light source image and a second lens portion for projecting the second light source image, and wherein the first lens portion and the second lens portion are formed in an integrated manner.

3. The vehicle headlamp according to claim 2, further comprising:

a partition member arranged between the first light source image or the second light source image and the projection lens and configured to suppress light being incident from the first light source image into an incident face of the second lens portion or suppressing light made incident from the second light source image into an incident face of the first lens portion.

4. The vehicle headlamp according to claim 2, further comprising:

a light shielding member arranged between the first light source image and the projection lens and configured to suppress light passing from the first light source image through an incident face of the first lens portion to arrive at an outgoing face of the second lens portion.

5. The vehicle headlamp according to claim 2, further comprising:

a light shielding member arranged between the second light source image and the projection lens and configured to suppress light passing from the second light source image through an incident face of the second lens portion to arrive at an outgoing face of the first lens portion.

6. The vehicle headlamp according to claim 1, wherein the light source image forming device comprises a first light source configured to form the first light source image and a second light source configured to form the second light source image.

7. A vehicle headlamp comprising:

a light source image forming device configured to form a first light source image and a second light source image; and a projection lens configured to project the first light source image and the second light source image to form a light distribution pattern, so that a first region of the light distribution pattern formed by projecting the first light source image and a second region of the light distribution pattern formed by projecting the second light source image have a common border with each other that extends in a common border direction, wherein the light source image forming device is configured to form the first light source image and the second light source image at positions spaced apart from each other along the common border direction, wherein the light source image forming device comprises a first light source image forming unit and a second light source image forming unit, wherein the first light source image forming unit includes a first light guiding member, the first light guiding member includes a front face facing the projection lens, and an opening portion is formed on the front face, wherein the second light source image forming unit includes a second light guiding member, the second light guiding member includes a front face facing the projection lens, and an opening portion is formed on the front face, wherein the opening portion of the first light guiding member is used as said first light source image, and wherein the opening portion of the second light guiding member is used as the second light source image.

* * * * *